US005836221A

United States Patent [19]

Hystead

[11] Patent Number: 5,836,221

[45] Date of Patent: Nov. 17, 1998

[54] PILL BOTTLE CAP REMOVAL DEVICE

[76] Inventor: Jeff Hystead, 6697 Barrisdale Dr., Mississauga, Ontario, Canada, L5N 2H5

[21] Appl. No.: 842,913

[22] Filed: Apr. 17, 1997

[51] Int. Cl.[6] ..... B67B 7/18

[52] U.S. Cl. ..... 81/3.25; 81/3.4

[58] Field of Search ..... 81/3.25, 3.31–3.33, 81/3.27, 3.4

[56] References Cited

U.S. PATENT DOCUMENTS

| | | | |
|---|---|---|---|
| 1,841,270 | 1/1932 | Aeschbach et al. | 81/3.25 |
| 2,499,032 | 2/1950 | Niblett | 81/3.25 |
| 2,761,337 | 9/1956 | Daniel | 81/3.25 X |
| 2,837,947 | 6/1958 | Handford et al. | 81/3.25 |
| 4,662,250 | 5/1987 | Kee | 81/3.25 |
| 4,781,352 | 11/1988 | Youngman | 81/3.25 X |

*Primary Examiner*—D. S. Meislin

[57] ABSTRACT

A new Pill Bottle Cap Removal Device for offering a device that facilitates an easier opening of child proof pill bottles. The inventive device includes a structure mountable, a support surface, a cone like tool, and a handle. In use, for people having problems with the dexterity of their fingers, the structure mountable 12 is mounted to the underside of a support surface 14 and the cone like tool 20 can be used to open child proof pill bottles from this location or the cone like tool 20 can be removed from the structure mountable 12 and used in one hand to remove the cap of a child proof pill bottle held in another hand.

9 Claims, 3 Drawing Sheets

54

PILL BOTTLE CAP REMOVAL DEVICE

BACKGROUND OF THE INVENTION

1. Field of the Invention

The present invention relates to child proof pill bottle caps and more particularly pertains to a new Pill Bottle Cap Removal Device for offering a device that facilitates an easier opening of child proof pill bottles.

2. Description of the Prior Art

The use of child proof pill bottle caps is known in the prior art. More specifically, child proof pill bottle caps heretofore devised and utilized are known to consist basically of familiar, expected and obvious structural configurations, notwithstanding the myriad of designs encompassed by the crowded prior art which have developed for the fulfillment of countless objectives and requirements.

Known prior art child proof pill bottle caps include U.S. Pat. No. 4,235,132; U.S. Pat. No. 4,052,917; U.S. Pat. No. Des. 302,232; U.S. Pat. No. 5,309,793; and U.S. Pat. No. 4,852,432.

While these devices fulfill their respective, particular objectives and requirements, the aforementioned patents do not disclose a new Pill Bottle Cap Removal Device. The inventive device includes a structure mountable, a support surface, a cone like tool, and a handle.

In these respects, the Pill Bottle Cap Removal Device according to the present invention substantially departs from the conventional concepts and designs of the prior art, and in so doing provides an apparatus primarily developed for the purpose of offering a device that facilitates an easier opening of child proof pill bottles.

SUMMARY OF THE INVENTION

In view of the foregoing disadvantages inherent in the known types of child proof pill bottle caps now present in the prior art, the present invention provides a new Pill Bottle Cap Removal Device construction wherein the same can be utilized for offering a device that facilitates an easier opening of child proof pill bottles.

The general purpose of the present invention, which will be described subsequently in greater detail, is to provide a new Pill Bottle Cap Removal Device apparatus and method which has many of the advantages of the child proof pill bottle caps mentioned heretofore and many novel features that result in a new Pill Bottle Cap Removal Device which is not anticipated, rendered obvious, suggested, or even implied by any of the prior art child proof pill bottle caps, either alone or in any combination thereof.

To attain this, the present invention generally comprises a structure mountable, a support surface, a cone like tool, and a handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Pill Bottle Cap Removal Device apparatus and method which has many of the advantages of the child proof pill bottle caps mentioned heretofore and many novel features that result in a new Pill Bottle Cap Removal Device which is not anticipated, rendered obvious, suggested, or even implied by any of the prior art child proof pill bottle caps, either alone or in any combination thereof.

It is another object of the present invention to provide a new Pill Bottle Cap Removal Device which may be easily and efficiently manufactured and marketed.

It is further object of the present invention to provide a new Pill Bottle Cap Removal Device which is of a durable and reliable construction.

An even further object of the present invention is to provide a new Pill Bottle Cap Removal Device which is susceptible of a low cost of manufacture with regard to both materials and labor, and which accordingly is then susceptible of low prices of sale to the consuming public, thereby making such Pill Bottle Cap Removal Device economically available to the buying public.

Still yet another object of the present invention is to provide a new Pill Bottle Cap Removal Device which provides in the apparatuses and methods of the prior art some of the advantages thereof, while simultaneously overcoming some of the disadvantages normally associated therewith.

Still another object of the present invention is to provide a new Pill Bottle Cap Removal Device for offering a device that facilitates an easier opening of child proof pill bottles.

Yet another object of the present invention is to provide a new Pill Bottle Cap Removal Device which includes a structure mountable, a support surface, a cone like tool, and a handle.

Still yet another object of the present invention is to provide a new Pill Bottle Cap Removal Device that can be operated by hand.

Even still another object of the present invention is to provide a new Pill Bottle Cap Removal Device that can be mounted to the underside of a counter.

These together with other objects of the invention, along with the various features of novelty which characterize the invention, are pointed out with particularity in the claims annexed to and forming a part of this disclosure. For a better understanding of the invention, its operating advantages and the specific objects attained by it uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
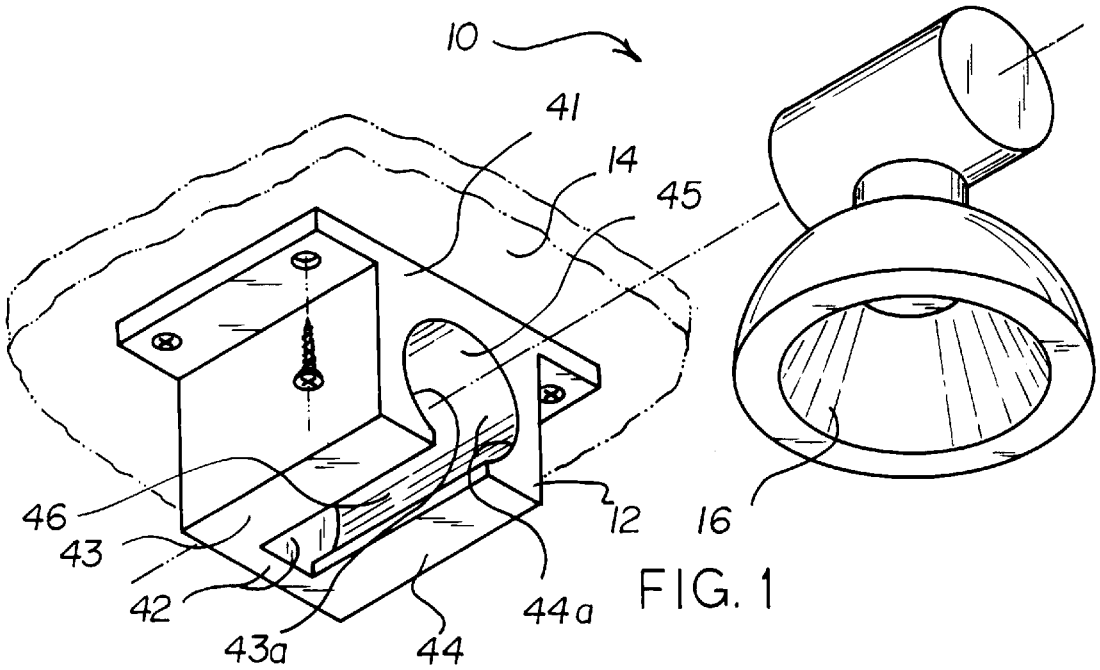
FIG. 1 is a right side perspective view of a first embodiment of a new Pill Bottle Cap Removal Device according to the present invention.

With reference now to the drawings, and in particular to FIGS. 1 through 6 thereof, a new Pill Bottle Cap Removal Device embodying the principles and concepts of the present invention and generally designated by the reference numeral 10 will be described.

More specifically, it will be noted that the Pill Bottle Cap Removal Device 10 comprises a structure mountable 12, a support surface 14, a cone like tool 20, and a handle 30 where the structure mountable 12 is further defined as a permanently mountable base 40 which is fixedly fastened to the support surface 14 that is ordinarily an underside surface of a counter top and where the cone like tool 20 is operated by the handle 30 and the handle 30 is matingly and removably received by the permanently mountable base 40.

As best illustrated in FIGS. 1 through 6, it can be shown that the permanently mounted base 40 is comprised of a base plate 41, a back wall 42, a left wall 43, and a right wall 44, where the back wall 42, the left wall 43, and the right wall 44 are vertical downward extensions of the base plate 41 and where the left wall 43 and the right wall 44 are integrally connected to the back wall 42.

Additionally, the left wall 43 is in a spaced apart relationship with the right wall 44 and together with the back wall 42 define an elongated aperture slot 46 for matingly receiving the cone like tool 20.

Furthermore, the left wall 43 and the right wall 44 have internal arcuate surfaces 43*a* and 44*a* respectively which are joined together in continuous noninterrupted fashion by an arcuate base plate lower surface 45 which matingly and slidingly receive the handle 30 which is cylindrical in shape.

Finally, the base plate 41 is completed by base mounting flanges 47 which extend laterally from the left wall 43 and the right wall 44 and are used to fasten the permanently mountable base 40 to the support surface 14.

Figure 3:
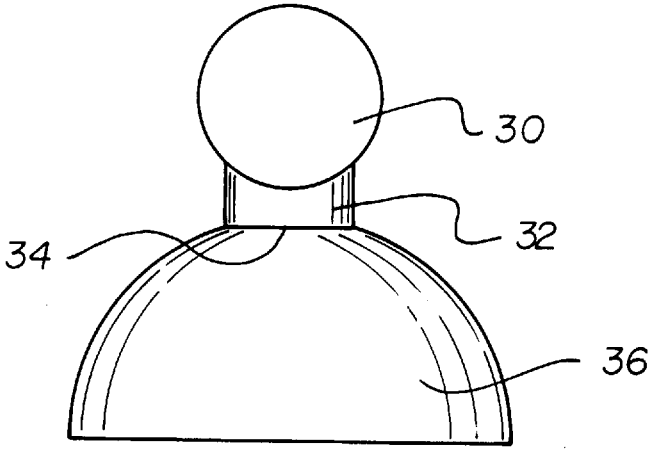
FIG. 3 is a side elevation view of a tool of the first embodiment of the present invention.
Figure 4:
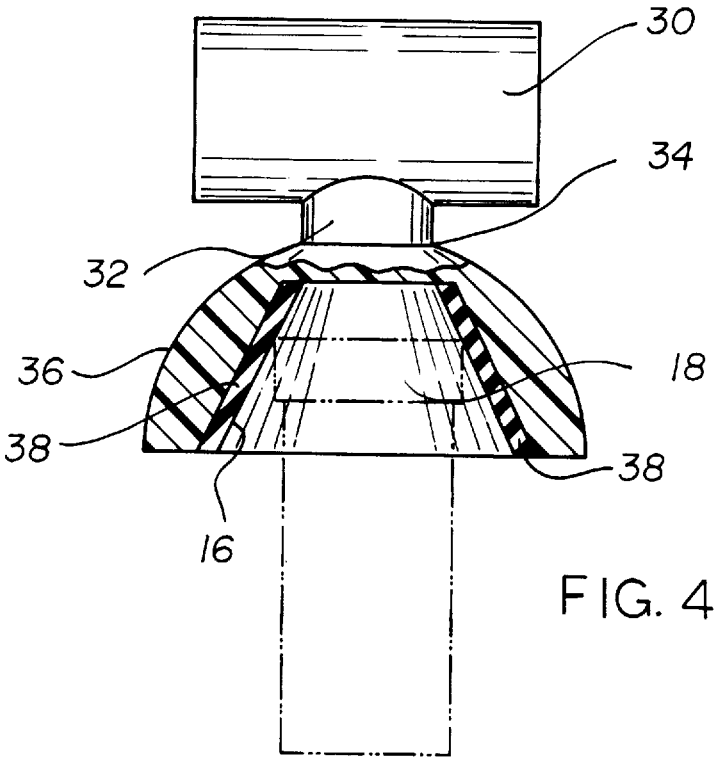
FIG. 4 is a cutaway view of FIG. 3 of the invention.

Referring to FIGS. 1, 3 and 4, the cone like tool 20 is comprised of the handle 30 which is traversly and integrally mounted centrally to a stem 32 which in turn integrally forms the vertex 34 of an arcuate hemispherical base 36 where the arcuate hemispherical base 36 further includes a cone like internal profile 16 which is set for receiving a wide variety of a plurality of sized bottle caps 18.

Additionally, a cone like rubber grip 38 is fixedly mated with the cone line internal profile 16 of the arcuate hemispherical base 36 and engages the wide variety of the plurality of sized bottle caps 18.

Figure 2:
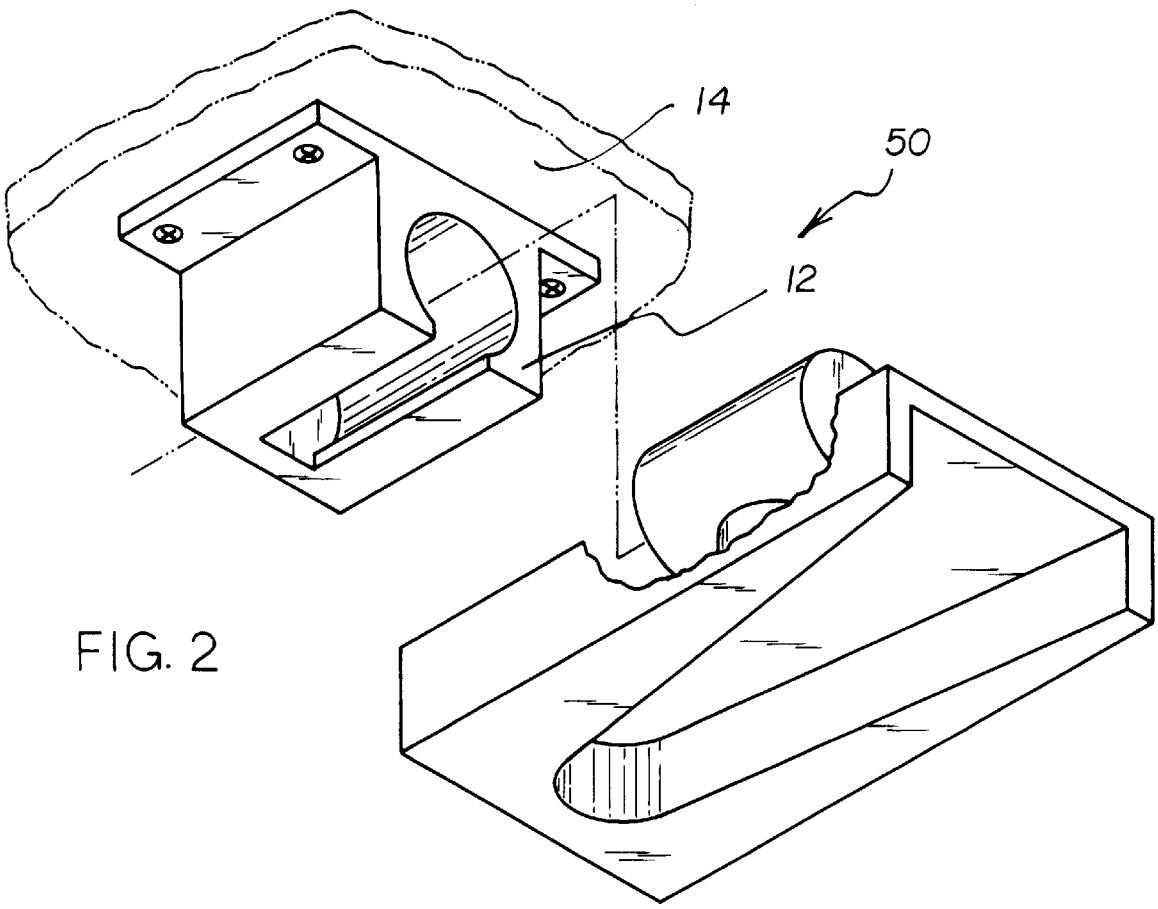
FIG. 2 is a right side perspective view of a second embodiment of a new Pill Bottle Cap Removal Device according to the present invention.
Figure 5:
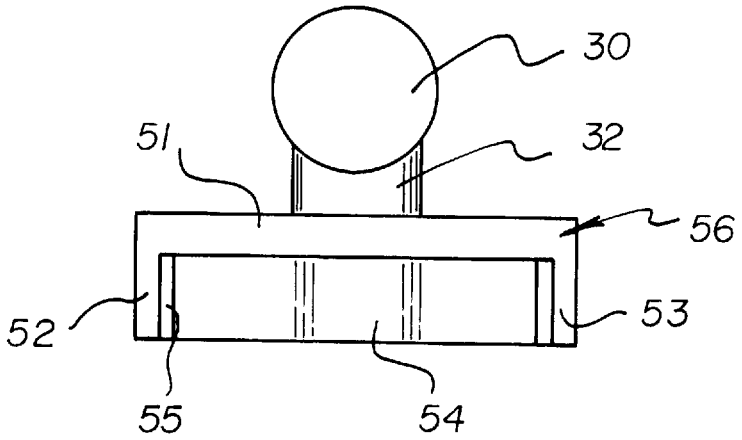
FIG. 5 is a side elevation view of a second tool of the second embodiment of the present invention.
Figure 6:
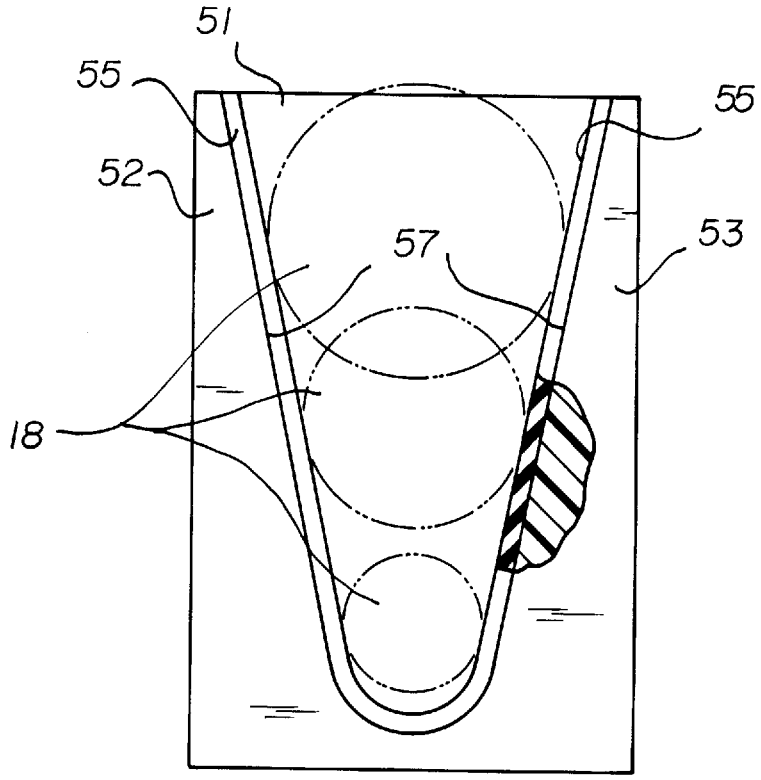
FIG. 6 is a cutaway view of FIG. 5 of the invention.

Referring to FIGS. 2, 5, and 6, an alternate embodiment 50 of the cone like tool 20 is illustrated. In the alternate embodiment 50, the handle 30 and the stem 32 remain substantially the same, however a generally horizontal base 56 is comprised of a top 51, a left base wall 52, a right base wall 53, and an end base wall 54 which extend away from the stem 32 and where the left base wall 52, and the right base wall 53 have inner converging edges 57 which converge from an open end opposite the end base wall 54 and conclude at the end base wall 54. The inner converging edges 57 are covered by a rubber grip 55 which is set for receiving a wide variety of a plurality of sized bottle caps 18.

In use, for people having problems with the dexterity of their fingers, the structure mountable 12 is mounted to the underside of a support surface 14 and the cone like tool 20 can be used to open child proof pill bottles from this location or the cone like 20 can be removed from the structure mountable 12 and used in one hand to remove the cap of a child proof pill bottle held in another hand.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A pill bottle cap removal device, comprising:

a structure adapted for mounting on a support surface, a cone-like tool, and a generally cylindrical handle;

wherein the structure is further defined as a base fixedly fastened to the support surface;

wherein the cone like tool is operationally coupled to the handle and the handle is matingly and removably received by the base;

wherein the base includes a base plate, a back wall, a left wall, and a right wall;

wherein the back wall, the left wall, and the right wall are vertical downward extensions of the base plate;

wherein the left wall and the right wall are integrally connected to the back wall;

wherein the left wall is in a spaced apart relationship with respect to the right wall such that the right wall, left wall and the back wall define an elongated aperture slot for matingly receiving the cone like tool; and wherein the left wall and the right wall each have internal arcuate surfaces said internal arcuate surfaces being joined together in continuous noninterrupted fashion by an arcuate base plate lower surface, the base plate lower surface being for matingly and sliding receiving the handle.

2. The pill bottle cap removal device of claim 1, wherein the base plate further includes base mounting flanges which extend laterally from the left wall and the right wall and are used to fasten the base to the support surface.

3. A pill bottle cap removal device comprising:

a base having a first side adapted for mounting to a support surface, said base having a protrusion extending away from said first side, said protrusion structured to have a cylindrical bore adapted for positioning substantially parallel to the support surface, said protrusion having a distal surface structured to have a slot extending between said distal surface and said bore such that said slot provides an opening into said bore;

a tool having a cylindrical handle grippable by a hand of a user, a receiving member and a stem coupling said handle to said receiving member;

wherein said cylindrical handle is insertable into said bore and wherein said stem is passable through said slot such that said tool is matably received by said base whereby said tool is prevented from rotating about a longitudinal axis of the tool with respect to the support surface when the tool is inserted into the base; and wherein said receiving member has engaging surfaces which converge toward each other for receiving and engaging a range of sizes of pill bottle caps.

4. The pill bottle cap removal device of claim 3, wherein the receiving member is generally rectangular in shape;

wherein the receiving member includes a cutout defined by converging side walls, said cutout having a wide end positioned at a first end of the receiving member such that a pill bottle cap is insertable into said cutout through said wide end; and wherein said side walls of said cutout converge toward each other and away from said wide end such that the opposing interior side walls of the receiving member contact the pill bottle cap as the cap is moved between the side walls.

5. The pill bottle cap removal device of claim 4 further comprising a rubber grip coupled to said interior side walls of said receiving member for enhancing gripping of said pill bottle cap when said receiving member abuts said pill bottle cap.

6. A kit for removing bottle caps comprising:

a base having a first side adapted for mounting to a support surface, said base having a protrusion extending away from said first side, said protrusion structured to have a cylindrical bore adapted for positioning substantially parallel to the support surface, said protrusion having a distal surface structured to have a slot extending between said distal surface and said bore such that said slot provides an opening into said bore;

a first tool including a cylindrical first tool handle grippable by a hand of a user, a first tool receiving member and a first tool stem coupling said first tool handle to said first tool receiving member, wherein said cylindrical first tool handle is insertable into said bore and wherein said first tool stem is passable through said slot such that said first tool is matably received by said base whereby said first tool is prevented from rotating about a longitudinal axis of the tool with respect to the support surface when the first tool is inserted into the base, and wherein said first tool receiving member has first tool engaging surfaces which converge toward each other for receiving and engaging a range of sizes of pill bottle caps, wherein the first tool engaging surfaces of the first tool receiving member form a cone-shaped space; and a second tool including a cylindrical second tool handle grippable by a hand of a user, a second tool receiving member and a second tool stem coupling said handle to said second tool receiving member, wherein said cylindrical second tool handle is insertable into said bore and wherein said second tool stem is passable through said slot such that said second tool is matably received by said base whereby said second tool is prevented from rotating about a longitudinal axis of the tool with respect to the support surface when the second tool is inserted into the base, and wherein said second tool receiving member has second tool engaging surfaces which converge toward each other for receiving and engaging a range of sizes of pill bottle caps, wherein the second tool receiving member is generally rectangular in shape, wherein the second tool receiving member includes a cutout defined by converging side walls, said cutout having a wide end positioned at a first end of the second tool receiving member such that a pill bottle cap is insertable into said cutout through said wide end, and wherein said side walls of said cutout converge toward each other and away from said wide end such that the opposing interior side walls of the receiving member contact the pill bottle cap as the cap is moved between the side walls.

7. The kit of claim 6 further comprising a rubber grips, one rubber grip coupled to a respective one of said first tool receiving member and said second tool receiving member, each rubber grip being for gripping said pill bottle cap when said respective receiving member abuts said pill bottle cap.

8. A pill bottle cap removal device comprising:

a base having a first side adapted for mounting to a support surface, said base having a protrusion extending away from said first side, said protrusion structured to have a cylindrical bore adapted for positioning substantially parallel to the support surface, said protrusion having a distal surface structured to have a slot extending between said distal surface and said bore such that said slot provides an opening into said bore;

a tool having a cylindrical handle grippable by a hand of a user, a receiving member and a stem coupling said handle to said receiving member;

wherein said cylindrical handle is insertable into said bore wherein said stem is passable through said slot such that said tool is matably received by said base whereby said tool is prevented from rotating about a longitudinal axis of the tool with respect to the support surface when the tool is inserted into the base; and wherein said receiving member has an engaging surface forming a cone-shaped space for receiving and engaging a range of sizes of pill bottle caps.

9. The pill bottle cap removal device of claim 8 further comprising a rubber grip coupled to said receiving member for gripping said pill bottle cap when said receiving member abuts said pill bottle cap.

* * * * *